US007261104B2

(12) United States Patent
Kiefer et al.

(10) Patent No.: US 7,261,104 B2
(45) Date of Patent: Aug. 28, 2007

(54) RESPIRATOR FACEPIECES

(75) Inventors: Eileen A. Kiefer, Pittsburgh, PA (US); Mark Cavaliere, Pittsburgh, PA (US); Roger P. Wolf, Butler, PA (US); Paul A. Zeller, Pittsburgh, PA (US); Klaus Schmidke, Berlin (DE)

(73) Assignee: Mine Safety Appliances Company, Pittsburgh, PA (US)

( * ) Notice: Subject to any disclaimer, the term of this patent is extended or adjusted under 35 U.S.C. 154(b) by 71 days.

(21) Appl. No.: 10/143,283

(22) Filed: May 10, 2002

(65) Prior Publication Data

US 2003/0047183 A1 Mar. 13, 2003

Related U.S. Application Data

(60) Provisional application No. 60/290,513, filed on May 11, 2001.

(51) Int. Cl.
*A62B 18/08* (2006.01)

(52) U.S. Cl. ..... 128/201.17; 128/205.25; 128/206.17; 128/206.23

(58) Field of Classification Search ..... 128/205.23, 128/206.17, 206.23, 206.24, 206.28, 267.11, 128/201.22, 201.23, 201.17, 201.25, 205.25, 128/207.11

See application file for complete search history.

(56) References Cited

U.S. PATENT DOCUMENTS

| | | | | | |
|---|---|---|---|---|---|
| 4,276,877 | A * | 7/1981 | Gdulla | 128/200.27 |
| 4,595,003 | A * | 6/1986 | Shoemaker et al. | 128/201.19 |
| 4,648,394 | A * | 3/1987 | Wise | 128/201.24 |
| 4,886,058 | A * | 12/1989 | Brostrom et al. | 128/206.12 |
| 4,961,420 | A * | 10/1990 | Cappa et al. | 128/207.12 |
| 5,297,544 | A * | 3/1994 | May et al. | 128/202.22 |
| 5,704,073 | A * | 1/1998 | Sword et al. | 2/427 |
| 5,732,695 | A * | 3/1998 | Metzger | 128/206.12 |
| 5,924,420 | A * | 7/1999 | Reischel et al. | 128/206.21 |
| 6,016,802 | A * | 1/2000 | Jackson | 128/205.25 |
| 6,176,239 | B1 * | 1/2001 | Grove et al. | 128/206.24 |
| 6,394,091 | B1 * | 5/2002 | Giorgini | 128/206.21 |
| 6,401,716 | B1 * | 6/2002 | Sword et al. | 128/206.21 |
| 6,561,189 | B2 * | 5/2003 | Schmidtke | 128/206.23 |

* cited by examiner

*Primary Examiner*—Michael J. Hayes
*Assistant Examiner*—Darwin P. Erezo
(74) *Attorney, Agent, or Firm*—James G. Uber, Esq.; Henry E. Bartony, Jr., Esq.

(57) ABSTRACT

The present invention provides an air-purifying respirator facepiece with a removable, one-piece filter element connector. It also has a removable component housing in the lens as well as a nosecup without inhalation valves that prevents fogging of the portion of the lens used for viewing.

9 Claims, 9 Drawing Sheets

10
60
30
500
550
530
70
400
90
300
20
80
50
400

10
20
60
660
670
70
400
80
50
90
300

36
30
500
70
40
270
272
32
20
10
60
34
550
670
50
670

300
400
90
60
20
70
670
10
400
50
80
660

10
500
60
20
80
300
520
670
620
50

RESPIRATOR FACEPIECES

CROSS-REFERENCE TO RELATED APPLICATION

This application claims benefit of U.S. Provisional Patent Application Ser. No. 60,290,513 filed May 11, 2001, the disclosure of which is incorporated herein by reference.

BACKGROUND OF THE INVENTION

The present invention relates generally to respirator facepieces and, more particularly, to full facepieces for use in environments in which toxic substances may be present.

A full facepiece, air-purifying respirator typically includes a face mask and a head harness for securing the face mask to the user. See, for example, U.S. Pat. No. 5,924,420. The face mask, which is sealed to the face of the user, typically includes a lens through which the user can view the surrounding environment. The face mask also includes one or more inhalation ports in fluid connection with one or more filtering elements (for example, chemical and particulate filtering canisters or cartridges) through which inspired air passes into the face mask and an exhalation port through with expired air passes out of the mask.

A nose cup is typically provided around the nose and mouth area of the user to assist in directing the flow of air into and out of the face mask. The nose cup, for example, assists in directing expired air to the exhalation port, reducing buildup of carbon dioxide and in preventing expired air, which is rich in moisture, from causing "fogging" of the face mask lens. In currently available respirators, the nose cup includes one or more check valves that allow inspired air to enter the nose cup, but prevent expired air from passing through the nose cup to contact the lens. Such valves can complicate the manufacture, assembly and maintenance of the respirator.

One or more air filters, such as filtering canisters, filtering cartridges or other filtering elements are typically removably attachable (for example, via threading or via a bayonet-type connection) to connectors or interfaces attached to the face mask as part of the inhalation port(s) of the face mask. In a number of current face masks, multi-component filter element connectors are manufactured separately from the remainder of the face mask and later attached to the face mask via, for example, cooperating threaded attachment members. Filter element connectors can also be attached to the face mask via an adhesive or via a polymeric welding bond. In general, the manner in which the filter element connectors are currently attached to face masks complicates manufacturing, assembly and maintenance of such face masks.

It is therefore, desirable to develop face masks and components therefor which reduce and, preferably, eliminate the above-identified and other problems with currently available face masks.

SUMMARY OF THE INVENTION

In one aspect, the present invention provides a facepiece and a nose cup for use in an air-purifying respirator including a lens through which a user views a surrounding environment. The nose cup includes at least one inspiration passage open to the interior of the respirator facepiece without an intervening check valve. The inspiration passage is preferably positioned to circulate air over an inner surface of the lens and particularly the viewing area of the lens.

The respirator facepiece preferably further includes at least one inspiration port and at least one baffle to direct the flow of air entering the respirator facepiece through the inspiration port of the respirator facepiece. The baffle preferably includes a flange with at least one opening positioned adjacent an inner surface of the lens to direct the flow of air over the inner surface of the lens. The baffle can contact the inner surface of the respirator lens above the inspiration port of the respirator facepiece and below the inspiration passage of the nose cup.

The inspiration passage of the nose cup is preferably positioned below the viewing area of the lens so that any expired air exiting the inspiration passage is directed below the viewing area of the lens. The inspiration passage can also be positioned on a forward section of the nose cup to assist in directing the flow of air over the inner surface of the lens of the respirator facepiece. The inspiration passage can also be formed at an angle in the nose cup to direct any air expired therethrough in a downward direction, away from the viewing area of the lens. Preferably, the inspiration passage is positioned substantially below the level of a user's eyes when the respirator facepiece is worn to prevent fogging in the viewing area of the lens during use.

In another aspect, the present invention provides a respirator facepiece including a lens through which a user views a surrounding environment, at least one inspiration port formed in the lens, and a filtering element connector attachable to the facepiece. The connector is preferably fabricated from an integral piece of polymeric material and is removably connectable to the lens. For example, the connector can include a rear flange and flexible tabs positioned forward of the rear flange. The flexible tabs flex (radially) inward when a forward portion of the connector is passed through the inspiration port and flex outward upon passing over a forward surface of the lens to retain the connector in connection with the inhalation port. In that regard, the rear flange abuts an inner surface of the lens and the flexible tabs abut an outer surface of the lens. The connector can, for example, include a bayonet connection on a forward end thereof to attach a filtering element. The bayonet connection includes a plurality of spaced flanges. Preferably, a filtering element can be attached to such a bayonet connection in only one orientation. The connector can, alternatively, include a threaded connection on a forward end thereof to attach a filtering element.

In a further aspect, the present invention provides a respirator facepiece including a lens section through which a user views a surrounding environment; at least one port formed in the lens, which includes a forward extending wall section; and a respirator component housing including a seal around the periphery thereof to form a seal with an interior wall of the wall section when the component housing is seated therein. The component housing can, for example, include a channel formed around the periphery thereof in which a seal (for example, an O-ring)is seated.

The respirator facepiece can include at least one flange positioned forward of a front surface of the wall section when the component housing is seated in the port and a retainer that seats between the front surface of the wall section and the flange to retain the component housing within the port. The retainer can, for example, be generally U-shaped to encompass a portion of the component housing.

The component housing can include an exhalation port and a check valve positioned over the exhalation port. Preferably, the exhalation port is positioned in the vicinity of the mouth of the user when the respirator is worn so that the user's voice can transmit through the check valve. The component housing can further include an inhalation port, a check valve positioned over the inhalation port, and a connector to place a filtering element in fluid connection with the inhalation port.

The present invention, along with the attributes and attendant advantages thereof, will best be appreciated and understood in view of the following detailed description taken in conjunction with the accompanying drawings.

DETAILED DESCRIPTION OF THE INVENTION

Figure 1B:
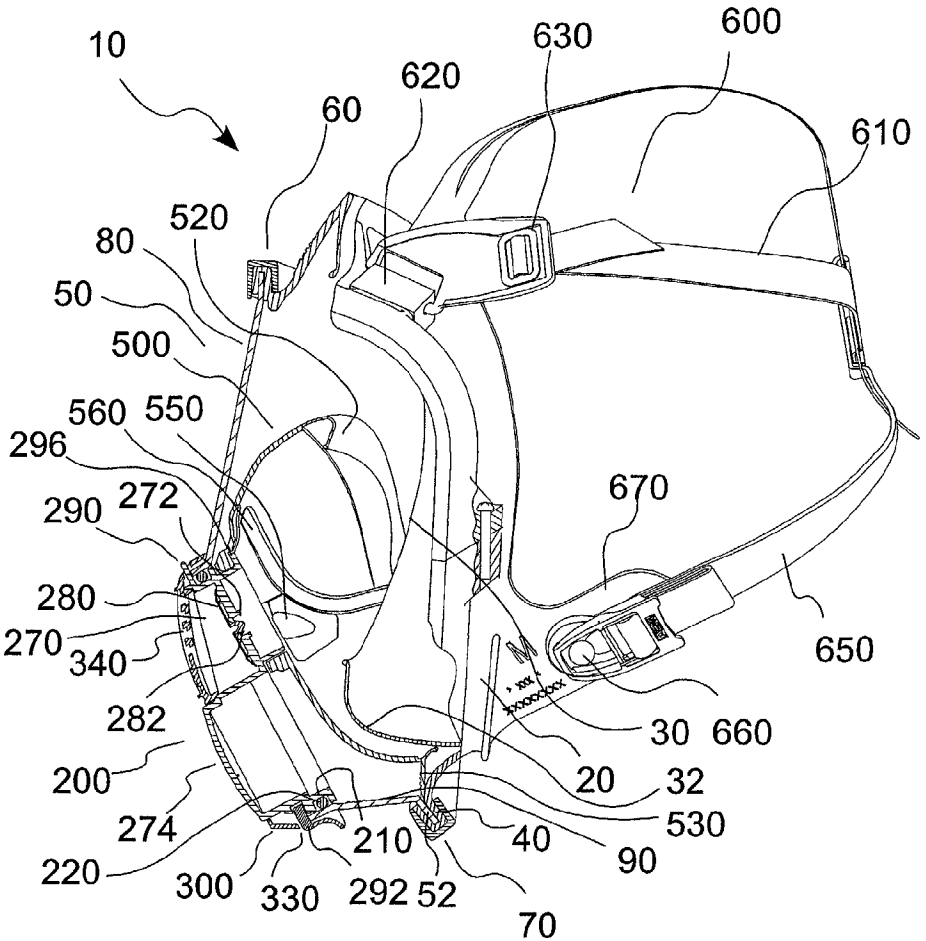
FIG. 1B illustrates a side, cross-sectional view of the respirator mask of FIG. 1A as worn by a user.

FIGS. 1A through 1C and FIGS. 9A through 9E illustrate one embodiment of a full facepiece respirator mask 10 of the present invention to which two filtering elements (for example, filtering canisters or filtering cartridges) can be mounted on the sides thereof. FIG. 2A through 2C illustrate another embodiment of a full facepiece respirator mask 10' of the present invention to which one filtering element can be mounted generally in the center thereof.

Returning to the embodiment of FIGS. 1A through 1C and FIGS. 9A through 9E, respirator mask 10 includes a face blank 20 (fabricated, for example, from a silicon rubber) that includes a rear opening 30 which seals around the face of a user. In general, opening 30 includes a chin cupping section 32 that seals around the chin area of the user, side sections 34 that seal around the sides of the user's face and a forehead section 36 that seals around the forehead of the user (see, for example, FIG. 9C). Face blank 20 further includes a forward opening or rim 40 that seals to a lens 50 of respirator mask 10. Face blank 20 can, for example, be sealingly attached to lens 50 via a peripheral rim or ring comprising an upper rim or ring member 60 and a lower rim or ring member 70, which can, for example, be connected together (via, for example, fasteners such as screws). Rim members 60 and 70 encompass and maintain in sealing, abutting engagement, rim 40 of face blank 20 and a rim 52 of lens 50 (see, for example, FIG. 1B).

Figure 1A:
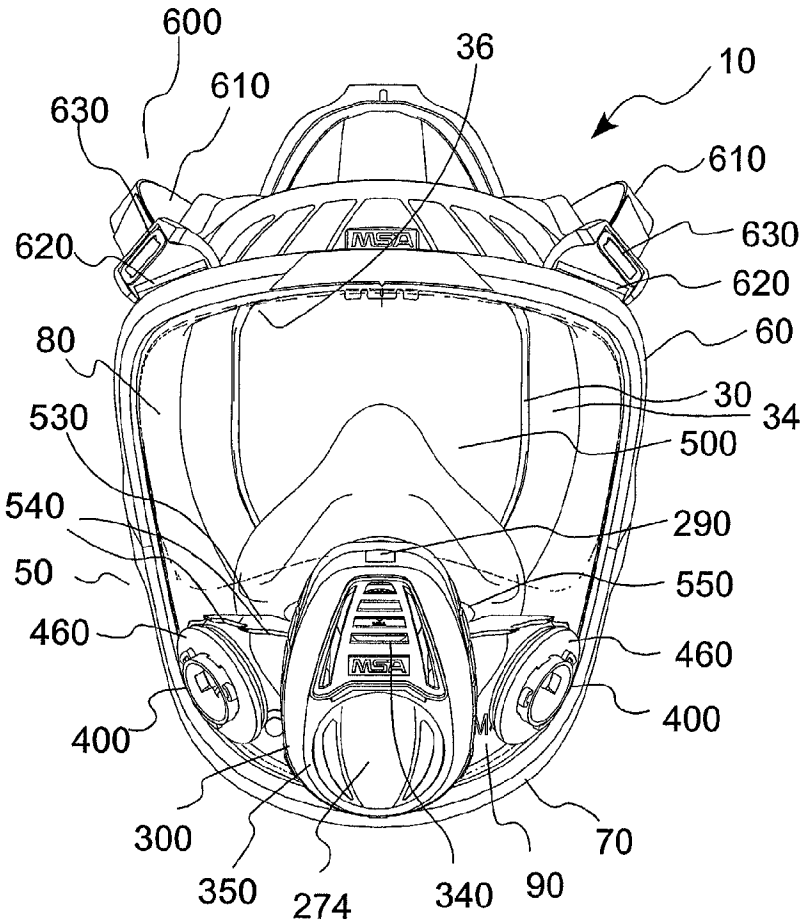
FIG. 1A illustrates a front view of one embodiment of an air-purifying respirator mask of the present invention in which the respirator mask can be fitted with two filtering cartridges on each side thereof.
Figure 1C:
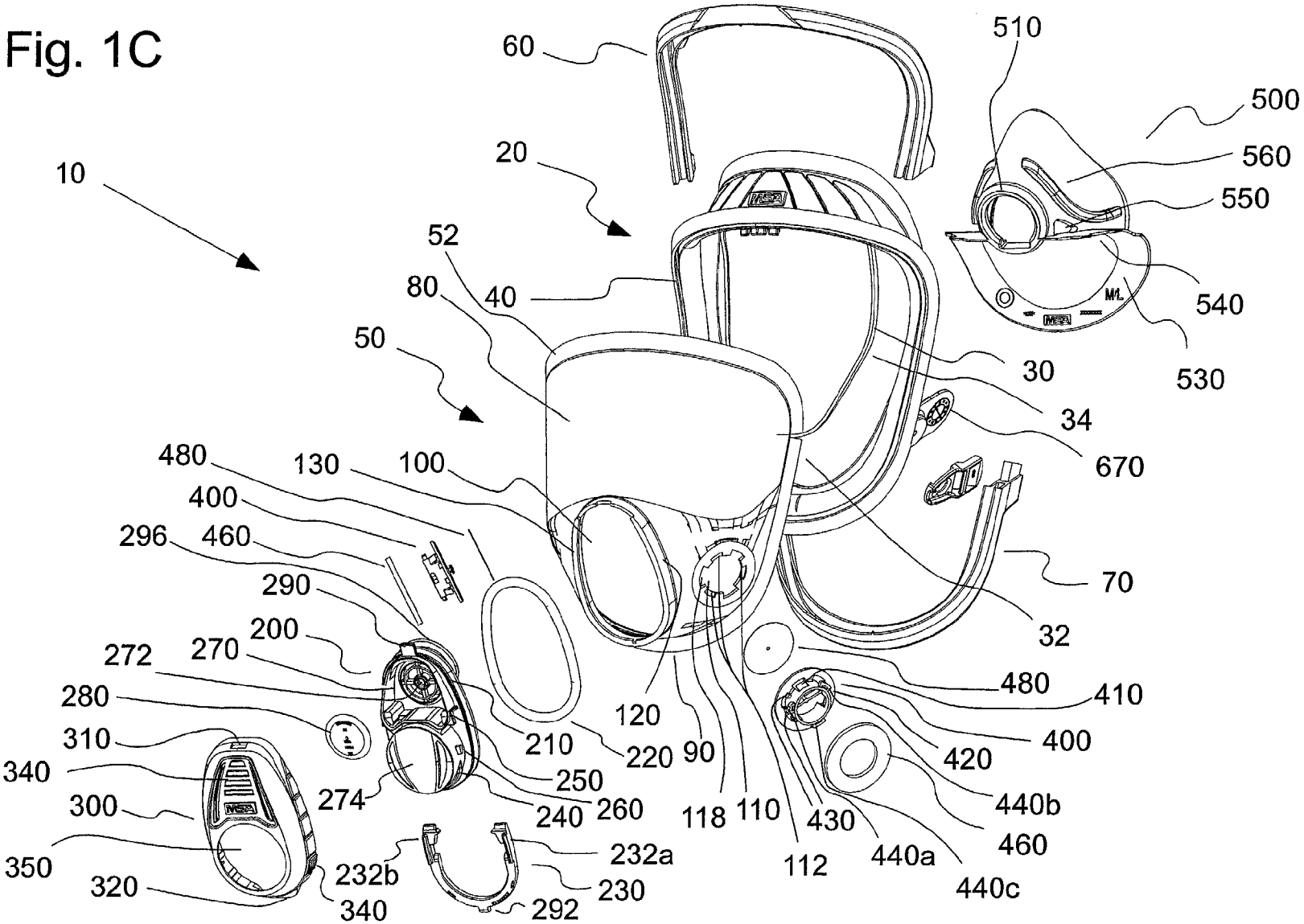
FIG. 1C illustrates a perspective or isometric disassembled or exploded view of the respirator mask of FIG. 1A.
Figure 2B:
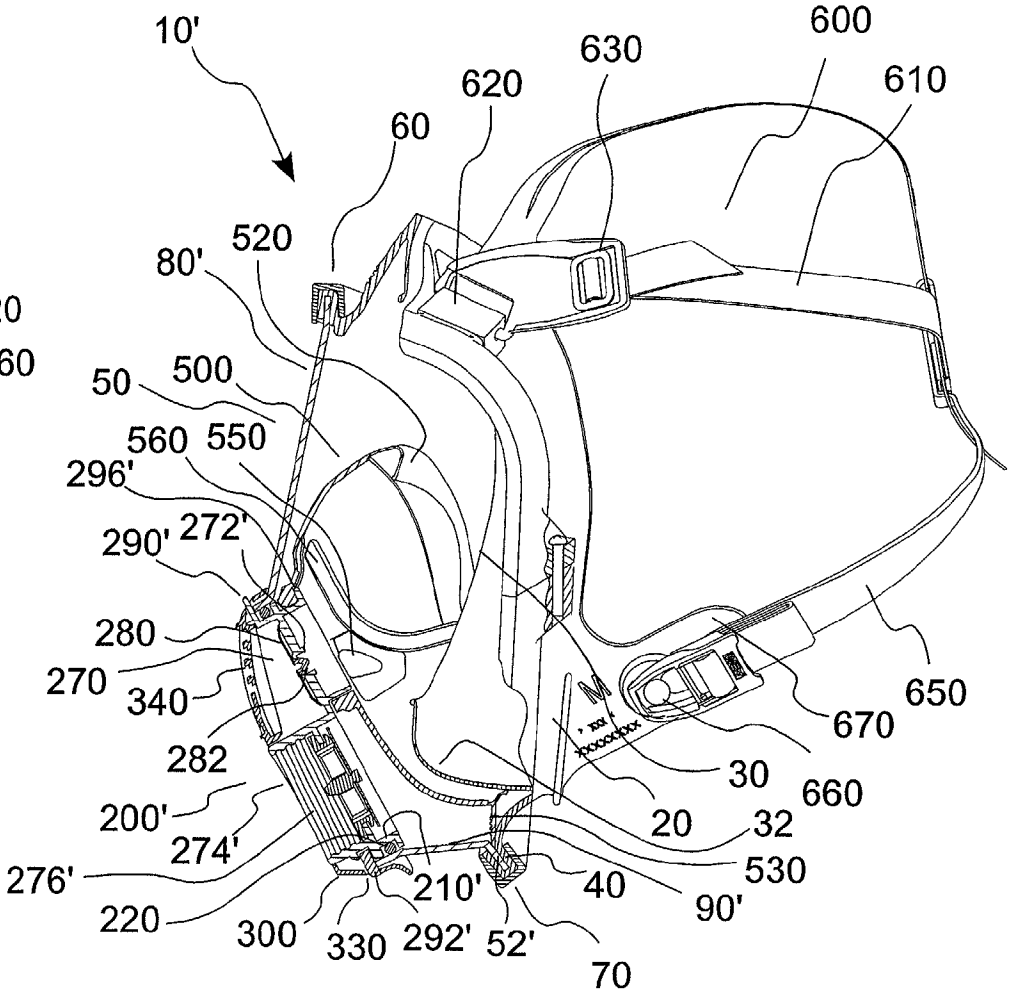
FIG. 2B illustrates a side, cross-sectional view of the respirator mask of FIG. 2A as worn by a user.
Figure 2A:
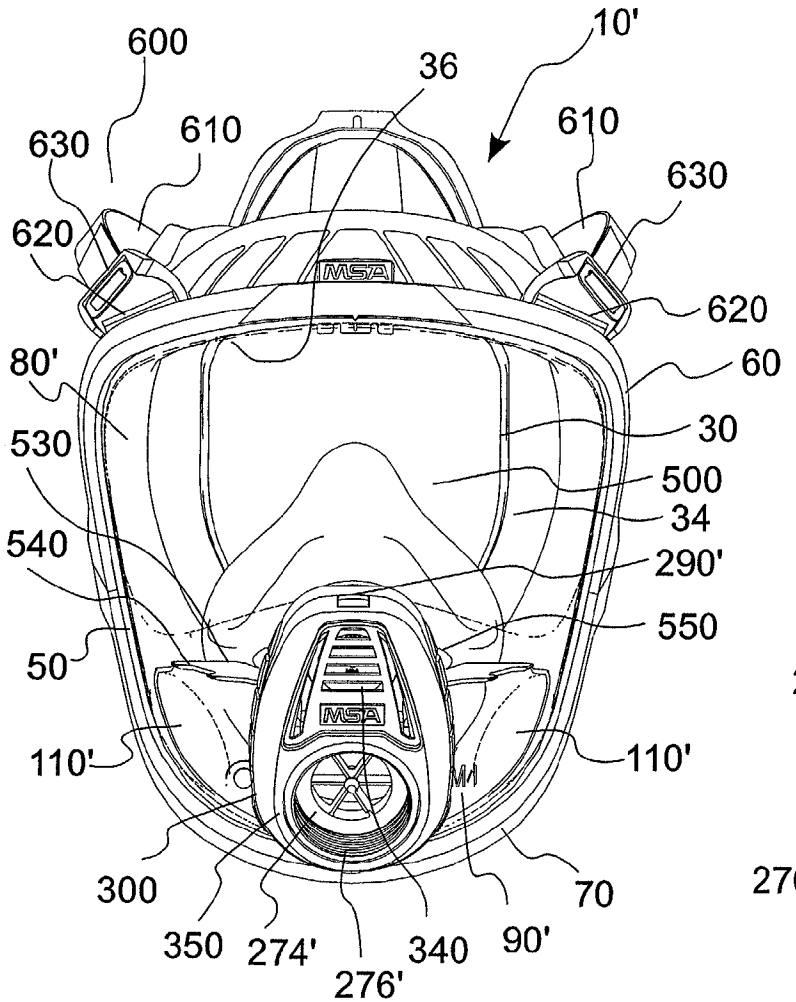
FIG. 2A illustrates a front view of one embodiment of a respirator mask of the present invention in which the respirator mask can be fitted with a single filtering cartridge in the center thereof.
Figure 2C:
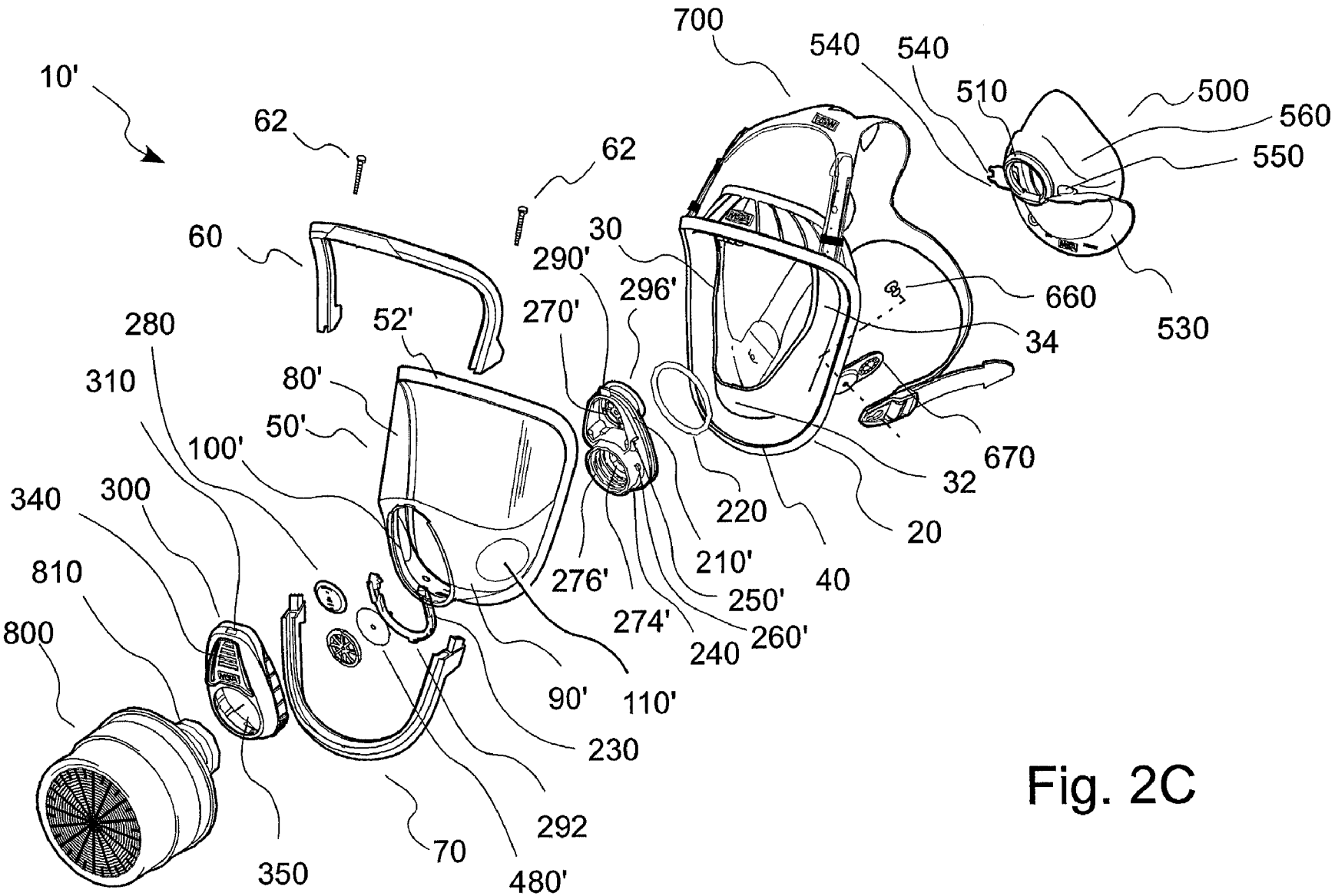
FIG. 2C illustrates a perspective or isometric disassembled or exploded view of the respirator mask of FIG. 2A.

Respirator mask 10 can, for example, have attached thereto an adjustable harness section 600 to encompass the head of the user and to maintain face blank 20 of respirator mask 10 in sealing engagement with the face of the user (see, for example, FIG. 1B). In the embodiment of FIGS. 1A through 1C, harness section 600 includes upper straps 610, which connect to clips 620 attached to or formed upon an upper rim member 60 via, for example, buckles 630. Lower straps 650 connect to an extending flange or button 660 formed on or attachable to an rearward extension 670 of face blank 20.

Lens 50 includes an upper lens section 80 through which the user views the surrounding environment and a lower respiration section 90 to which respiration/filtering components as described below are attachable. In one embodiment, each of upper section 80 and lower section 90 were formed integrally from optical quality, transparent polycarbonate. In the embodiment of FIGS. 1A through 1C, lower section 90 includes a generally central port or opening 100 and two side openings or ports 110 formed therein. Port 100 is formed in the forward end of an extending wall section 120 that extends forward from the remainder of lower section 90.

A respirator component housing 200 is removably attachable to forward extending section 120. In that regard, housing 200 includes a seal around the periphery thereof that forms a sealed engagement, fit or connection with the internal wall of extending section 120. Housing, 200 can, for example, include a channel or groove 210 around the periphery thereof in which a sealing member (for example, a standard O-ring 220) is seated. A seal can also, for example, be formed integrally around the periphery of housing 200 from a polymeric material suitable to form a sealing connection with extending section 120. Housing 200 and O-ring 220 are dimensioned such that O-ring 220 forms a sealing engagement, fit or connection with the inner wall of forward extending section 120 when housing 200 (with O-ring 220 seated in channel 210) is inserted into extending section 120 from the rear. Housing 200 of the present invention can be of generally any shape to sealingly seat in a port of virtually any cooperating shape, whereas many currently available housings for use in respirator masks are limited in shape (for example, many must be rounded to be equipped with cooperating threading). Housing 200 of the present invention can be shaped, for example, to optimize visibility of the user of respirator mask 10 by appropriately positioning a filtering cartridge attached thereto.

After housing 200 is seated in extending section 120, a retainer such as retaining clip 230 is attached to housing 200 to retain housing 200 in position within extending section 120. In the embodiment of FIGS. 1A through 1C, retaining clip 230 is formed of a flexible or resilient polymeric material and forms a snap fit with housing 200. In that regard, generally U-shaped retaining clip 230 is slid upward and around housing 200 to seat in a gap formed between a forward surface 130 of extending section 120 and a flange or flanges 240, 250 and 260 formed on housing 200. Housing 200 can be removed from connection with extending section 120, simply by manually spreading one or both of extending arms 232*a* and 232*b* of retaining clip 230 and sliding retaining clip 230 out of connection with housing 200. Housing 200 can then be pushed rearward to disconnect the sealing engagement formed between O-ring 220 and the inner wall of extending section 120.

Housing 200 also includes an exhalation port 270 to which an elastomeric flap valve 280 (as known in the art) is connected via cooperation of a rearward extending tab 282 (see, for example, FIG. 1B) of valve 280 and a generally central passage 272 formed in exhalation port 270. Valve 280 opens very easily upon exhalation by a user of respirator mask 10 but closes upon inspiration to prevent inspired air from passing through exhalation port 270. Exhalation port 270 is preferably positioned generally directly in front of the mouth of the user to facilitate transmission of expired air and to facilitate transmission of and understanding of the speech of the user. In that regard, sound waves are transmitted comparatively well through valve 280 of exhalation port 270. In current respirator masks or face masks, a KAPTON® (polyimide) diaphragm or a very thin section of plastic are provided in the face mask or in a component housing thereof to provided for voice transmission. Transmission of the user's voice through an exhalation port positioned generally in front of the user's mouth simplifies manufacture and reduces cost without sacrificing performance. In the embodiment of FIGS. 1A through 1C, exhalation port 270 is formed in a well in housing 200 to improve the resonance of the user's voice as transmitted therethrough. Housing section 200 can, for example, be injection molded as an integral part from a polymeric material such as, for example, a polycarbonate, a polyester or, preferably, a polycarbonate/polyester blend.

Respirator mask 10 also includes a housing cover 300 that is attached to housing 200 by first passing a tab 290 formed on the upper end of housing 200 through a passage 310 form in the upper end of cover 300, and then applying rearward force to a lower end (for example, to flange 320) of cover 300 to form a snap fit between cover 300 and housing 200 via cooperation of a passage 330 (see, for example, FIG. 1B) formed in the lower end of cover 300 and tab 292 (see, for example, FIG. 1B) extending from a lower end of retainer 230. Cover 300 can, for example, be injection molded as an integral part from a resilient polymeric material such as , for example, a polycarbonate, a polyester or, preferably, a polycarbonate/polyester blend.. To remove cover 300 from connection with housing 200, the user can compress areas 340 on each side of cover 300 to deform housing cover 300 and enable disconnection of tab 292 from passage 330. Housing cover 300 includes a vent 340 to allow expired air and voice transmission from exhalation port 270 to pass therethrough.

Figure 3C:
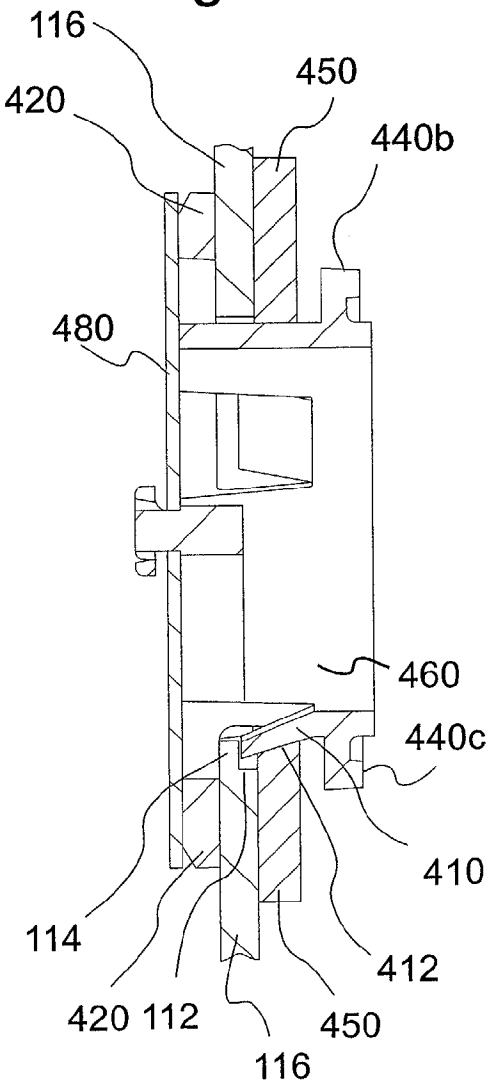
FIG. 3C illustrates a side, cross-sectional view of the bayonet connector of FIG. 3A as connected to the lens of the respirator mask of FIG. 1A
Figure 3B:
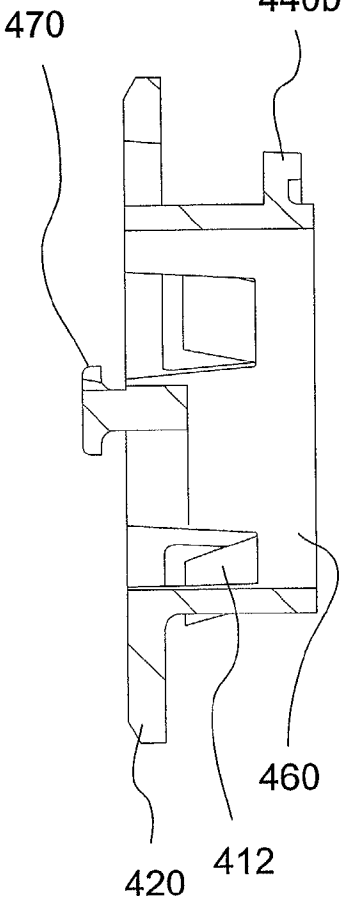
FIG. 3B illustrates a side, cross-sectional view of the bayonet connector of FIG. 3A.
Figure 3A:
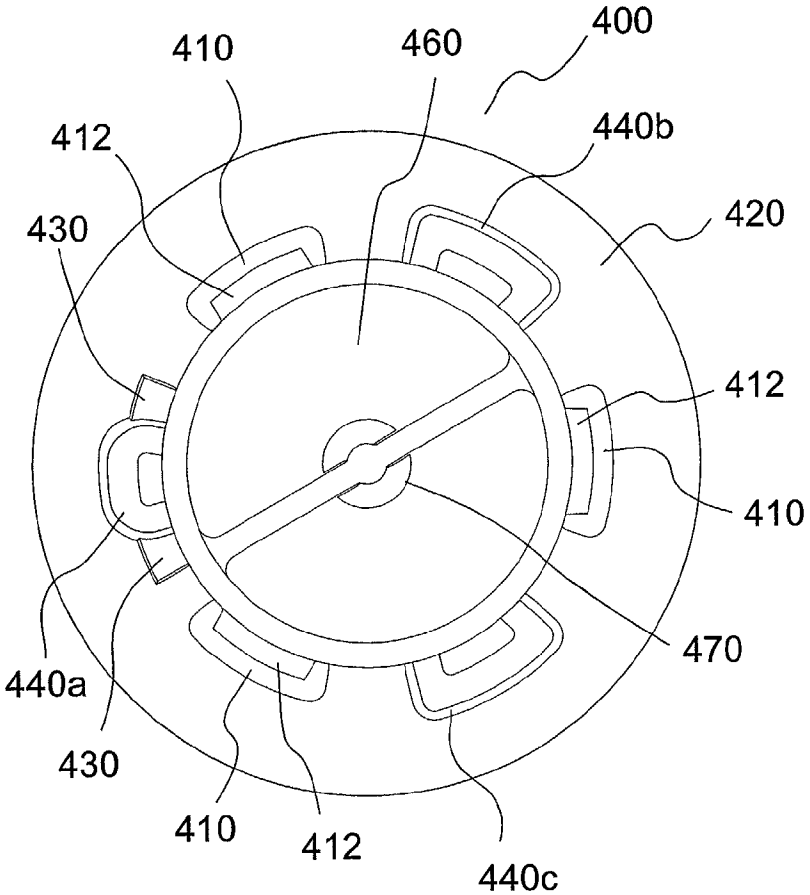
FIG. 3A illustrates a front view of a bayonet connector of the present invention.
Figure 4A:
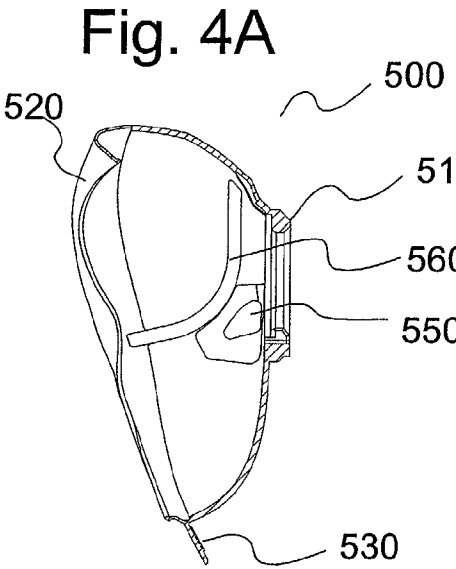
FIG. 4A illustrates a side, cross-sectional view of an embodiment of a nose cup of the respirator mask of the present invention.
Figure 4B:
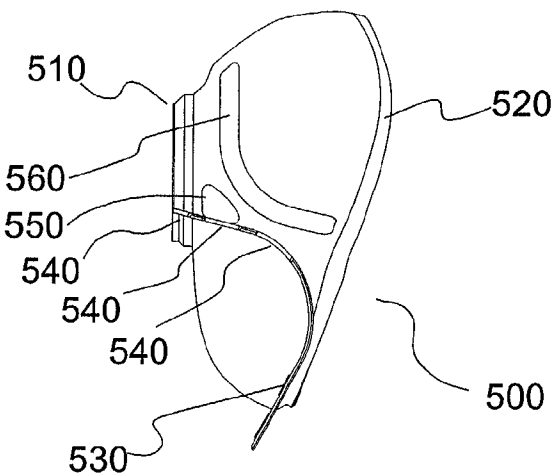
FIG. 4B illustrates an opposite side view of the nose cup of FIG. 4A.
Figure 4C:
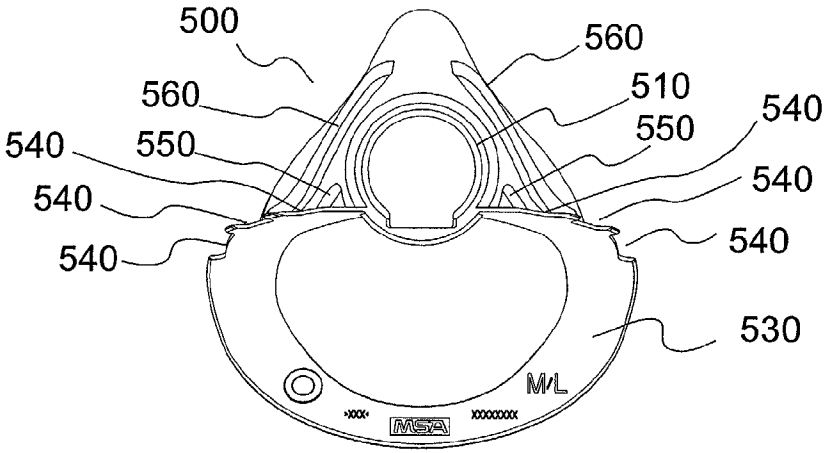
FIG. 4C illustrates a front view of the nose cup of FIG. 4A.
Figure 4D:
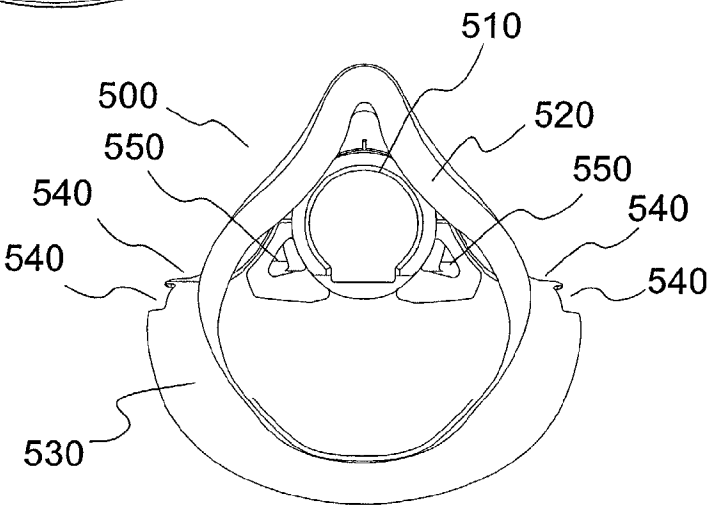
FIG. 4D illustrates a rear view of the nose cup of FIG. 4A.
Figure 5A:
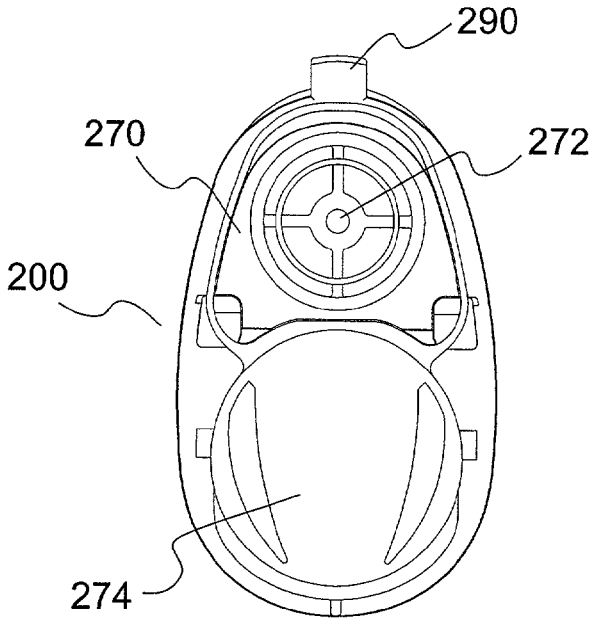
FIG. 5A illustrates a front view of the component housing of the respirator mask of FIG. 1A.
Figure 5B:
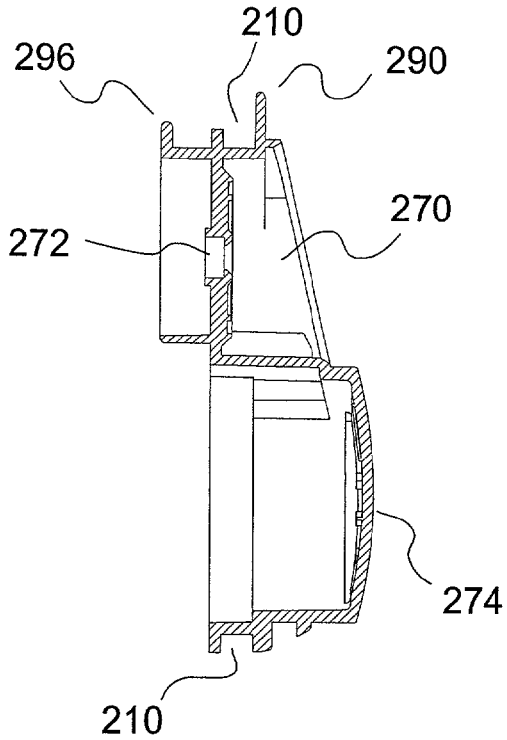
FIG. 5B illustrates a side, cross-sectional view of the component housing of FIG. 5A.
Figure 6A:
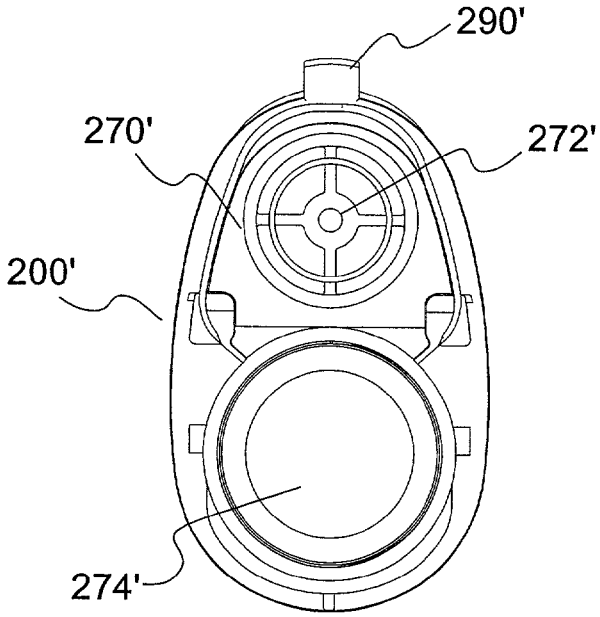
FIG. 6A illustrates a front view of the component housing of the respirator mask of FIG. 2A.
Figure 6B:
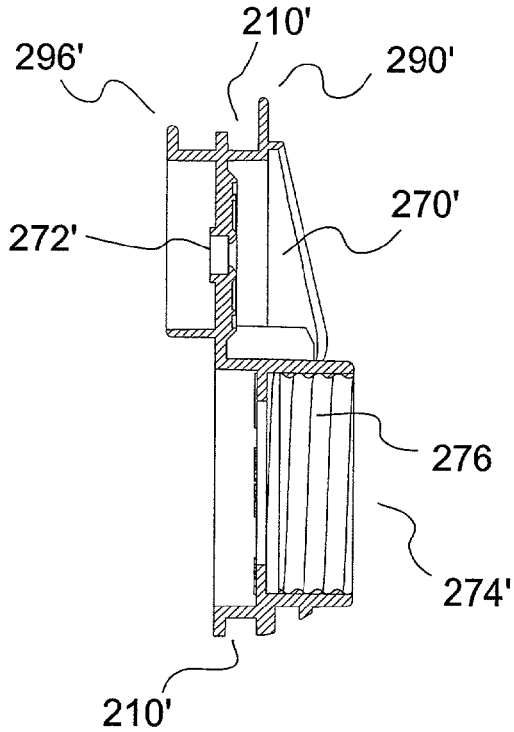
FIG. 6B illustrates a side, cross-sectional view of the component housing of FIG. 6A.

Respirator mask 10 also includes one or more connectors such as bayonet-type connectors 400 that are preferably removably connected to lens 50 via inspiration ports 110. Although, connectors 400 are illustrated, for example, in FIGS. 1A through 1C as bayonet-type connectors, one skilled in the art understands that other types of connectors such as, for example, threaded connectors (that is, connectors including threading on a forward section thereof for cooperative attachment to a threaded filtering element) can be used in the present invention. Filtering element connectors 400 are operable to attach filtering elements such as cartridges or canisters as known in the art. Connectors 400 are, for example, removably connectable to lens 50 via cooperation of slots 112 formed around the periphery of inhalation ports 110 and flexible leaf springs or abutment tabs 410 (see, for example, FIGS. 3A through 3C) disposed around connectors 400. To attach connector 400 to face lens 50, connector 400 is pushed through inhalation ports 110 from the rear with tabs 410 aligned with slots 112. A sloped surface 412 of tabs 410 contacts the radial outward edge of slots 112, causing tabs 410 to flex radially inward. Once tabs 110 pass the forward edge of slots 112, tabs 112 flex radially outward to abut a ledge 114 formed in slots 112 (see FIG. 3C). Abutment of a rearward flange 420 of connectors 400 with lens wall 116 in the area of inhalation ports 110 and abutment of tabs 410 with ledges 114 of slots 112 retains connectors 400 in connection with lens 50.

Preferably, bayonet-type connectors are aligned in a predetermined rotational position within inhalation ports 110 so that cartridges (not shown), which may be of varying shapes and sizes are connected thereto in a manner that does not interfere with the vision of the user of respirator mask 10. Connectors 400 can, for example, include indicator tabs or flanges 430 that align with a uniquely dimensioned slot 118 formed around the periphery of inhalation ports 110 to properly align connectors 400 within inhalation ports 110. Connectors 400 include flanges such as flanges 440*a*, 440*b* and 440*c* to connect a cartridge or canister via a bayonet connection as known in the art. One or more of flanges 440*a*, 440*b* and 440*c* can be uniquely dimensioned or shaped to allow connection of a cartridge or canister in only a desired orientation. In the present embodiment, flange 440*a* is uniquely shaped and/or dimensioned.

A gasket 450, as known in the art, can be provided to assist in forming a seal between the cartridge and the forward surface of lens 50. In that regard, gasket 450 is compressed between the cartridge and lens 50 when the cartridge is connected to connector 400.

A passage 460 is formed through the center of connector(s) 400 to allow air drawn through an attached cartridge to pass into respirator mask 10 through inhalation port 110 of lens 50 during inhalation by the user. A one-way check valve such as an elastomeric flap valve 480 can be placed over the rearward end of passage 460 to allow inspired air into lens 50 through passage 460, but to prevent expired air from exiting lens 50 through passage 460. Valve 480 can, for example, be attached to bayonet connector 400 via a rearward flange 470 that cooperates with a passage 482 formed generally centrally in the elastomeric check valve 480.

Connectors 400 are preferably removable by flexing tabs 410 radially inward to allow connectors 400 to be forced rearward, through inhalation ports 110. A damaged bayonet connector 80 can, for example, be readily replaced. In currently available respirator masks in which such connectors are adhered or welded (for example, via polymer welding bonds such as an ultrasonic welding bond) to a respirator mask, such replacement is not possible. Moreover, in case that a connector is adhered or welded to a respirator mask (for example, to the lens thereof) the material of the connector and the material of the respirator mask component to which the connector is adhered or welded must be the same or closely matched, which significantly limits the choice of materials for the connector. In the present invention, however, no such material matching is required and very strong and durable materials can be chosen for connectors 400. In other currently available respirator masks in which filtering element connectors are removable, such removable connectors are manufactured in two or more cooperating pieces or components, causing additional manufacturing complexity, time and cost, whereas connectors 400 can, for example, be injection molded from an integral piece of polymer materials such as polypropylene, nylon, or, preferably, glass-filled nylon.

Respirator mask 10 also includes a nose cup 500 (see, for example, FIGS. 1A through 1C and FIGS. 4A through 4D) that assists in directing the flow of air into, within and out of respirator mask 10. Nose cup 500 can, for example, be formed integrally from an elastomeric polymeric material such as a thermal plastic elastomer (for example, SANOPRENE, VERSAFLEX® OR KRATON®). Prior to connecting component housing 200 to lens 50 as described above, nose cup 500 can be attached to housing 200 from the rear by, for example, extending or stretching a forward exhalation port or opening 510 of nose cup 500 around a flange 296 formed on the upper, rear of housing 200 to place port 510 in connection with exhalation port 270. Alternatively, nose cup 500 can be attached to housing 200 after housing 200 is connected to lens 50.

An upper rear flap 520 around the upper, rear periphery of nose cup 500 contacts and generally encompasses the nose section of the user when respirator mask 10 is donned. Rear flap or flange 520 also contacts face blank 20. A lower, chin portion of nose cup 500 passes below chin section 32 of face blank 20 as illustrated, for example, in FIG. 1B. A lower baffle or flange 530 of nose cup 500 preferably contacts the inner surface of lower section 90 of lens 50. During inhalation, air is drawn through inhalation ports 110 (that is, through a filtering cartridge connected to bayonet connector 400). Check valve 480 opens and check valve 280 closes during inhalation. Flange or baffle 530 directs the inspired air over the interior wall of lens 50, through baffle openings 540 formed in baffle 530 and through inspiration openings 550 formed in nose cup 500.

During exhalation, a positive pressure within respirator mask 10 (caused, in part, by closed inhalation check valves 480) generally prevents moisture laden expired air from passing through inspiration openings 550, and the majority of expired air passes directly through exhalation port 27 via open exhalation check valve 280. Expired air that does pass through inspiration openings 550 can cause only minimal fogging of lens 50 well below the viewing area of lens section 80, for example, because of the positioning of inspiration openings 550 below the eyes of the user and below the viewing area of lens section 80. As illustrated, for example, in FIG. 4D, inspiration openings 550 can also be angled or oriented downward to assist in directing any expired air passing therethrough downward and away from the viewing area of lens section 80. Thus, any fogging does not hamper the view of the user of respirator mask 10. In comparison, many currently available nose cups for use in currently available respirator masks have inspiration openings on the top of the nose cup or elsewhere and require check valves to prevent carbon dioxide buildup within the respirator mask and to prevent expired air from contacting the lens of the respirator mask and causing fogging. Such check valves are unnecessary in respirator mask 10. Moreover, any minimal fogging that may occur out of the viewing area of lens section 80, occurs in the vicinity of inspiration openings 550, and is quickly cleared by air inspired on the next breath, which passes over the inner surface of lens 50 as directed by baffle openings 540 and by inspiration openings 550. The circulation of air over the inner surface of lens 50 also prevents buildup of carbon dioxide in respirator mask 50.

Inspiration openings 550 of nose cup 550 are, for example, preferably placed on a forward area of nose cup 550 so as to be generally forward facing and generally close in position to the inner surface of lens 50, thereby causing circulation of air over the inner surface of lens 50. Moreover, baffle openings 540 are preferably positioned adjacent to the inner surface of lens 50 and preferably do not extend very far rearward from the inner surface of lens 50 to cause circulation of air passing through baffle openings 540 over the inner surface of lens 50 and, particularly, over the inner surface of upper lens section 80. The discovery of the present inventors that lens fogging and carbon dioxide buildup can be avoided or prevented using a nose cup having inspiration openings or ports open to the interior of a respirator mask without intervening check valves is quite surprising.

Nose cup 500 can, for example, include a number of ridges 560 or other structural features to add strength thereto and to maintain the shape thereof. Ridges 560 can also increase the size range of a particular nose cup 500 by expanding/contracting or accordioning to conform nose cup 500 to a range of user sizes.

Another or alternative embodiment of a respirator mask 10' of the present invention is illustrated in FIGS. 2A through 2C. In general, many of the components of respirator mask 10' are identical to those of respirator mask 10 and those components are designated by the same numbering as used above. Other components are modified to varying degrees and are designated with a similar number, but with the designation "'". As discussed above, the primary difference between respirator mask 10' and respirator mask 10 is that respirator mask 10 includes only one, generally central port, which cooperates with inhalation and exhalation ports formed in component housing 200' as described below.

Respirator mask 10' includes face blank 20 as described above which seals around the face of a user. FIGS. 2A and 2B illustrate harness section 600 attached to respirator mask 10'. In FIG. 2C, an alternative harness section 700 (which can be used with either of respirator masks 10 or 10') is illustrated connected to face blank 20 and to upper ring member 60.

As described above, forward opening or rim 40 of face blank 20 seals to a lens 50' of respirator mask 10'. Rim members 60 and 70 encompass and maintain in sealing, abutting engagement, rim 40 of face blank 20 and a rim 52' of lens 50' (see, for example, FIG. 2B).

As described for lens 50, lens 50' includes an upper lens section 80' through which the user views the surrounding environment and a lower respiration section 90' to which respiration/filtering components as described below are attachable. Upper lens section 80', and lower section 90', are formed integrally from optical quality, transparent polycarbonate. In the embodiment of FIGS. 2A through 2C, lower section 90' includes only a generally central port or opening 100' for connection of housing 200' thereto. In general, lens 50 and lens 50' are formed using very similar molds, other than ports 110 of lens 50 are not formed in lens 50'. In that regard, lens 50' is formed with solid sections or blanks 110' at the positions in which ports 110 are formed in lens 50.

Respirator component housing 200' is removably attachable to a forward extending section 120' of port 100 as described above for housing 200. In that regard, housing 200' can include a channel or groove 210' around the periphery thereof in which a sealing member such as standard O-ring 220 is seated. Housing 200' and O-ring 220 are dimensioned such that O-ring 220 forms a sealing engagement, connection or fit with the inner wall of forward extending section 120' when housing 200' (with O-ring 220 seated in channel 210') is inserted into extending section 120' from the rear. After housing 200' is seated in extending section 120', retaining clip 230 is attached to housing 200' to retain housing 200' in position within extending section 120'.

Housing 200' also includes an exhalation port 270' to which elastomeric flap valve 280 is connected as described above. Housing 200' further includes an inhalation port 274' having threading 276' formed around the interior thereof which cooperates with threading 810 of a filtering cartridge 800 to connect cartridge 800 to inhalation port 274'. Other types of connections as known in the art (for example, bayonet connections as described above) can also be used to attach a filtering cartridge. Housing cover 300 is attached to housing 200' as described above so that vent 340 is in fluid connection with exhalation port 270' and opening 350 is in fluid connection with inhalation port 274'.

Housing 200' can, for example, be injection molded from a polymeric material in generally the same manner and form as housing 200. However, housing 200' is formed with threaded inhalation port 274' therein whereas housing 200 includes a solid blank 274 in the area of inhalation port 274' (see, for comparison, FIGS. 1A through 1C, FIGS. 2A through 2C, FIGS. 5A through B and FIGS. 6A through 6B).

Figure 7B:
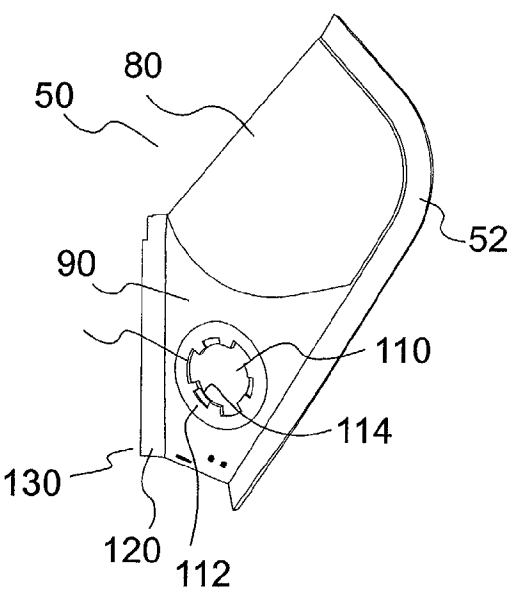
FIG. 7B illustrates a side view of the lens of FIG. 7A.
Figure 7A:
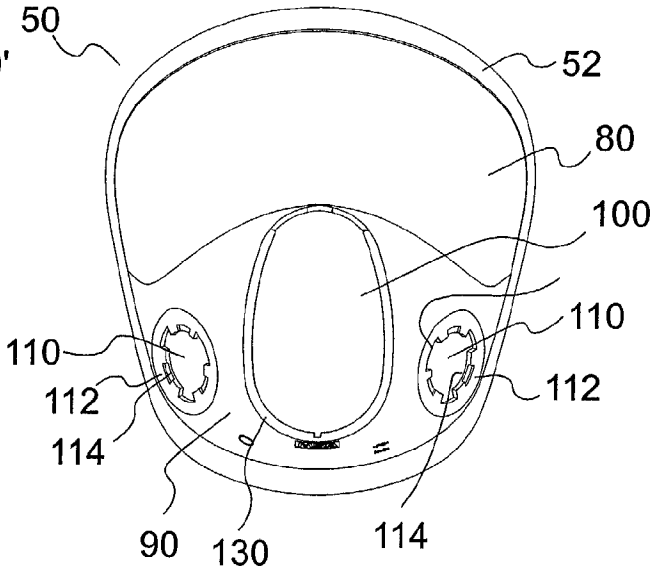
FIG. 7A illustrates a front view of the lens of the respirator mask of FIG. 1A.
Figure 7D:
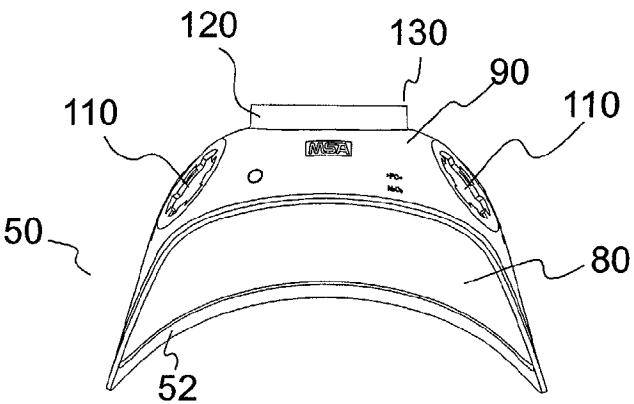
FIG. 7D illustrates a top view of the lens of FIG. 7A.
Figure 8:
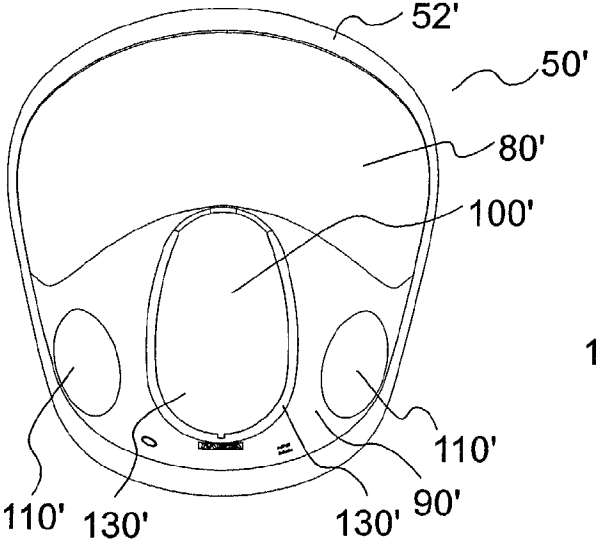
FIG. 8 illustrates a front view of the lens of the respirator mask of FIG. 2A.
Figure 7C:
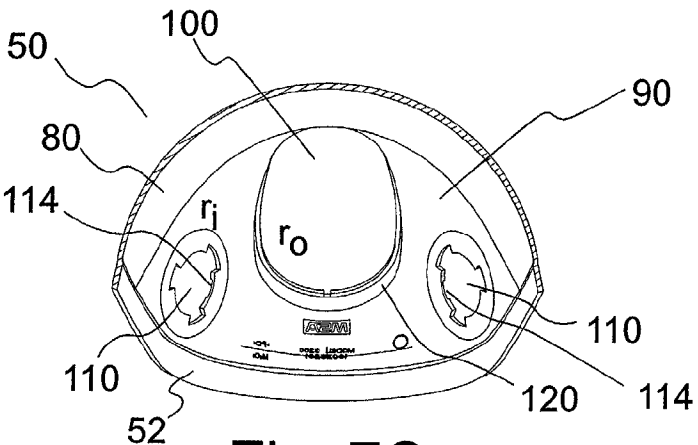
FIG. 7C illustrates a top, perspective or isometric view of the lens of FIG. 7A in which the lens section is shown in cross section.
Figures 9A, 9B, 9C, 9D, 9E:
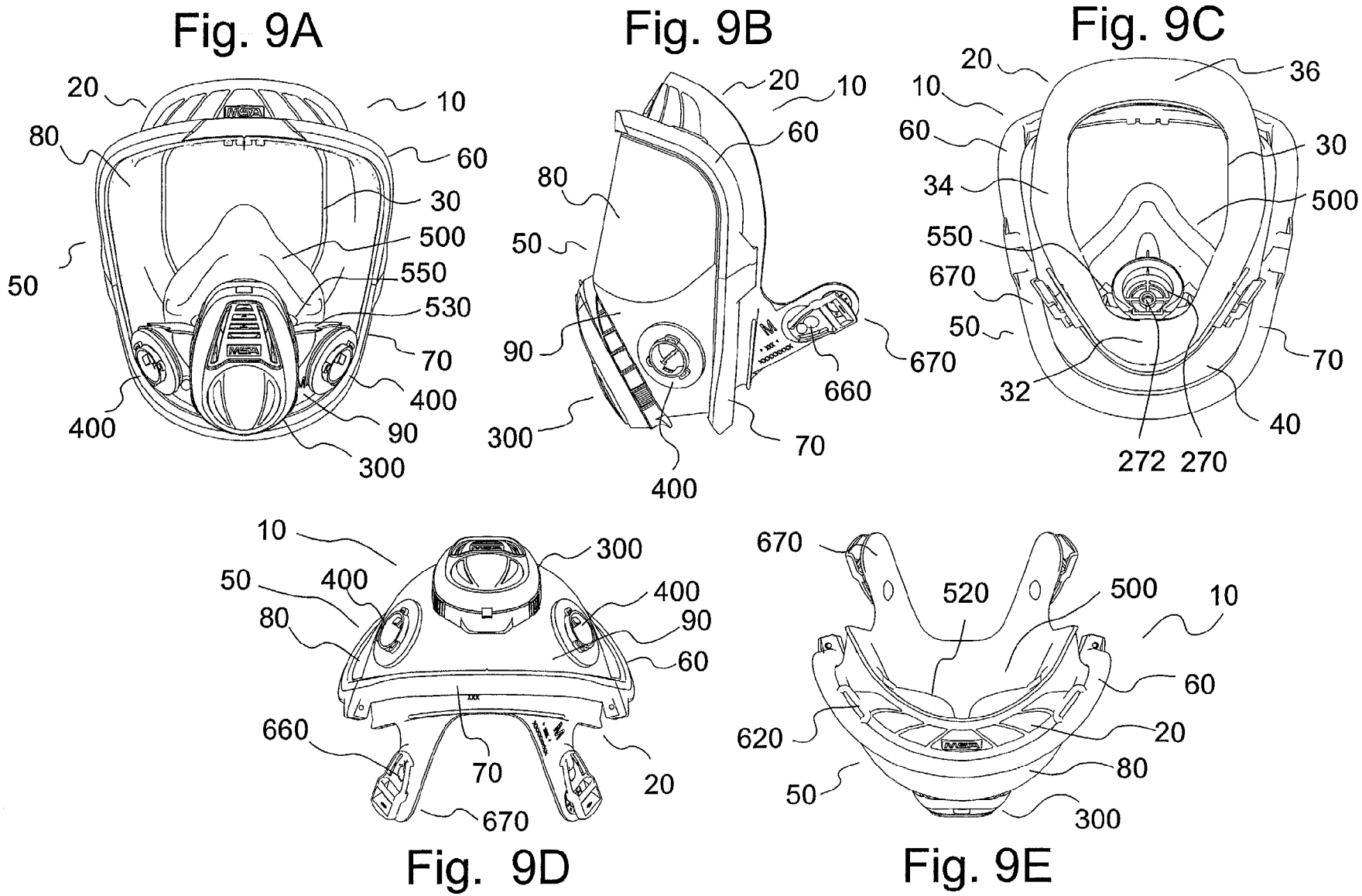
FIG. 9A illustrates a front view of the respirator mask of FIG. 1A without a harness section attached thereto.
FIG. 9B illustrates a side view of the respirator mask of FIG. 1A without a harness section attached thereto.
FIG. 9C illustrates a rear view of the respirator mask of FIG. 1A without a harness section attached thereto.
FIG. 9D illustrates a bottom view of the respirator mask of FIG. 1A without a harness section attached thereto.
FIG. 9E illustrates a top view of the respirator mask of FIG. 1A without a harness section attached thereto.

Likewise, lens 50 and lens 50' can, for example, be injection molded from a polymeric material (for example, a transparent polycarbonate) in generally the same manner to have generally the same overall shape and dimensions (see, for example, FIGS. 7A through 8). As described above, lens 50' includes solid blanks 110', whereas lens 50 is formed with inhalation ports 110 in the same area. Otherwise, the shape and dimensions of lens 50 and lens 50' are generally identical. Manufacture of components of respirator masks 10 and 10' with similar molds and with a number of interchangeable components reduces manufacture costs as compared to substantially differing designs.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. An air-purifying, full-face respirator facepiece comprising:

a lens through which a user views a surrounding environment; and a nose cup contained within the respirator facepiece, the nose cup including a seal to form a sealing contact around a nose and mouth of a user and at least one inspiration passage that is positioned on a forward section of the nose cup and passes through the nose cup to the interior of the respirator facepiece without an intervening check valve so that the inspiration passage forms a flow path between the lens and an interior at the nose cup without an intervening check valve, the inspiration passage being positioned to circulate air over a viewing area of the lens.

2. The respirator facepiece of claim 1 further comprising at least one inspiration port formed in the lens and a baffle to direct the flow of air entering the respirator facepiece through the inspiration port.

3. The respirator facepiece of claim 2 wherein the baffle comprises a flange with at least one opening positioned adjacent an inner surface of the lens to direct the flow of air over the viewing area of the lens.

4. The respirator facepiece of claim 2 wherein the inspiration passage is positioned below the viewing area of the lens to direct any expired air exiting the inspiration passage below the viewing area of the lens.

5. The respirator facepiece of claim 4 wherein the baffle contacts the inner surface of the lens above the inspiration port of the respirator facepiece and below the inspiration passage of the nose cup.

6. The respirator facepiece of claim 2 wherein the inspiration passage is angled to direct any air expired therethrough in a downward direction.

7. The respirator facepiece of claim 2 wherein the inspiration passage is below the level of a user's eyes when the respirator facepiece is worn.

8. The respirator facepiece of claim 2 comprising two inspiration ports, each without an intervening check valve, and two baffles, one of each located on a right half of the nose cup and one of each located on a left half of the nose cup.

9. The respirator facepiece of claim 8 wherein each baffle contacts an inner surface of the lens below one of the inspiration passages of the nose cup.

* * * * *